United States Patent [19]

Braun

[11] 4,262,415

[45] Apr. 21, 1981

[54] HAIR TRIMMER

[75] Inventor: Gebhard Braun, Kelkheim, Fed. Rep. of Germany

[73] Assignee: Braun Aktiengesellschaft, Frankfurt am Main, Fed. Rep. of Germany

[21] Appl. No.: 68,716

[22] Filed: Aug. 22, 1979

[30] Foreign Application Priority Data

Aug. 24, 1978 [DE] Fed. Rep. of Germany ..... 2836959

[51] Int. Cl.[3] ..... B26B 19/10

[52] U.S. Cl. ..... 30/34.1; 30/90; 30/223

[58] Field of Search ..... 30/34.1, 90, 223

[56] References Cited

U.S. PATENT DOCUMENTS

| | | | |
|---|---|---|---|
| 1,723,323 | 8/1929 | Bartlett | 30/223 |
| 2,870,534 | 1/1959 | Angst et al. | 30/34.1 |
| 3,111,755 | 11/1963 | Futterer et al. | 30/34.1 X |
| 3,319,334 | 5/1967 | Bond et al. | 30/34.1 X |
| 3,460,250 | 8/1969 | Liska | 30/223 X |
| 3,962,785 | 6/1976 | Poel | 30/34.1 X |
| 4,031,617 | 6/1977 | Tanaka et al. | 30/34.1 |
| 4,074,427 | 2/1978 | Marchetti et al. | 30/34.1 |
| 4,118,863 | 10/1978 | Sandy | 30/223 X |

*Primary Examiner*—Frank T. Yost

*Attorney, Agent, or Firm*—Michael J. Striker

[57] ABSTRACT

A hair trimmer has a shear blade assembly mounted in a frame and composed of a stationary blade and a reciprocating blade which slides on the stationary one. One or more biasing springs are interposed between the frame and the reciprocating blade to urge the same into proper contact with the stationary blade. A pivoted lever is interposed between the spring(s) and the reciprocating blade and serves to divert the biasing force to particular portions of the blades, such as the cutting edge, where it is needed while at the same time relieving other portions so that overall friction between the blades is reduced.

10 Claims, 4 Drawing Figures

FIG. 1
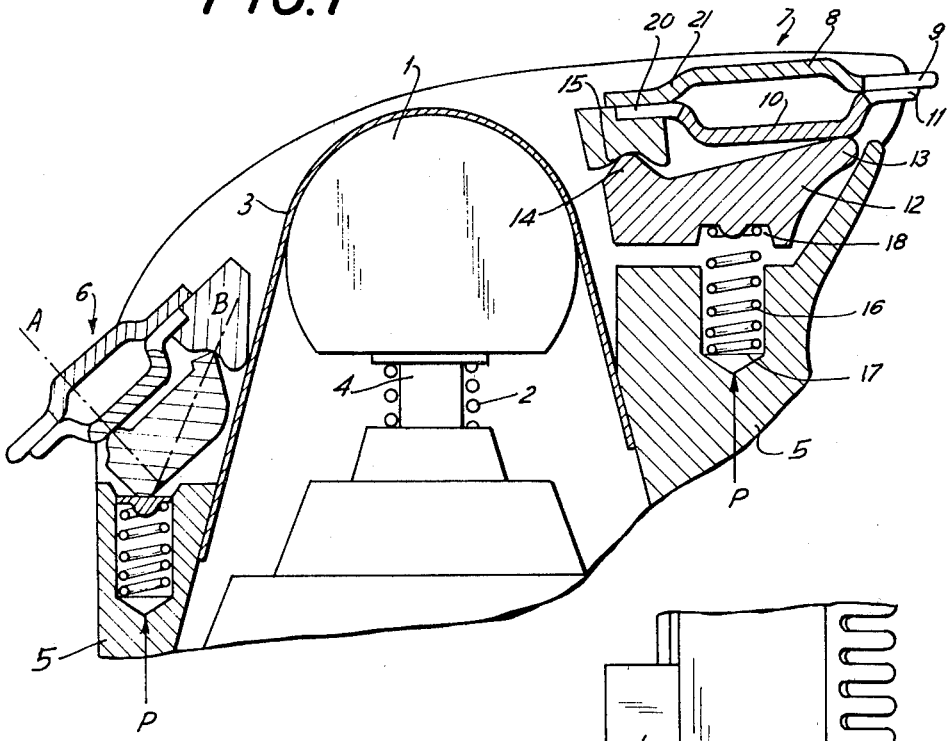
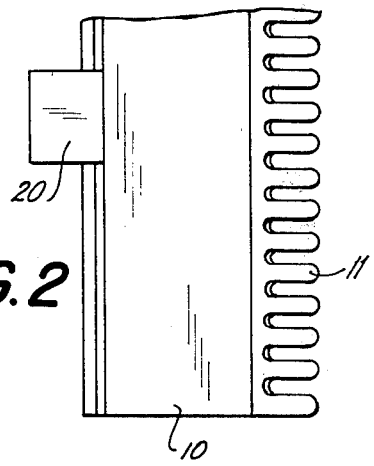
FIG. 2
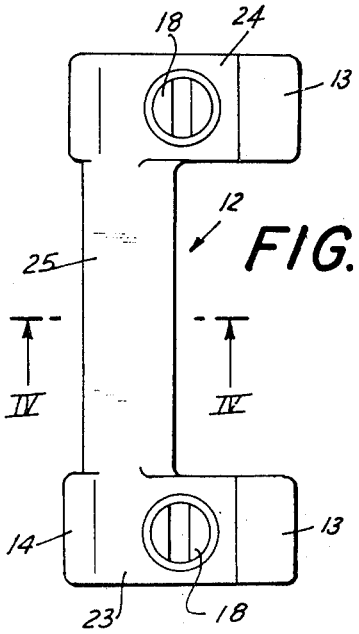
FIG. 3
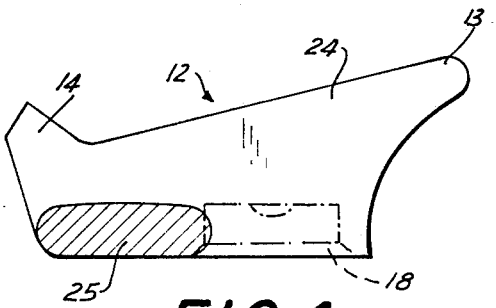
FIG. 4

HAIR TRIMMER

BACKGROUND OF THE INVENTION

The present invention relates to a hair trimmer for long hair, e.g. scalp hair or beard hair.

More particularly, the invention relates to a hair trimmer of this type which may be used to advantage in dryshavers and has a shear blade assembly of two contacting blades.

In this type of blade assembly one blade is usually stationary and the other slides on it and is reciprocated relative to it. Both blades have serrated cutting edges and hair enters into the serrations and is severed due to the reciprocation. A hair trimmer operating on this principle is known, e.g. from German Allowed Application DT-OS No. 2,019,978.

A problem with these trimmers is that the blades must tightly engage one another over their entire length and with the most uniform possible contact pressure—but that too much friction must be avoided. In the aforementioned prior-art trimmer the reciprocating blade engages the stationary blade—at its edge which is opposite the serrated cutting edge—only with one or a few projections, in order to avoid having to have a long continuous surface because that might lead to warping of the blade.

The two blades are urged into contact with one another by a biasing spring. To reduce the resulting friction the prior art proposes to interpose a glide bar between the spring and the reciprocating blade but—since friction is still high and may vary uncontrollably, due to fluctuations in manufacturing tolerances—it is also proposed to so construct the trimmer as a structural unit that it can be separately tested for proper functioning before being installed in a dryshaver.

This is technically a viable solution to the problem of excess friction because units exhibiting friction of a degree sufficient to interfere with proper operation can be discarded. However, the testing expenses and the costs of having to discard unsatisfactory units are high. From an economic viewpoint, therefore, a different solution is highly desirable.

SUMMARY OF THE INVENTION

It is an object of the invention to provide such a different solution.

A more particular object is to provide a hair trimmer of the type in question which is simple to manufacture.

Another object is to provide such a hair trimmer wherein friction is significantly reduced, to the point where it can be overcome with a minimum of driving force.

Still a further object is to provide such a hair trimmer which, since friction is reduced, requires no testing and where the discarding of reject units due to high friction is substantially eliminated.

Pursuant to these objects, and still others which will become apparent hereafter, one feature of the invention resides in a hair trimmer, particularly for dryshavers. Briefly stated the inventive hair trimmer may comprise a frame, a shear blade assembly, comprising a stationary first member on the frame and a second member in sliding engagement with the first member, biasing spring means between the frame and second member and tending to exert biasing forces upon the second member at first locations of the same, and means interposed between the biasing spring means and the second member and operative for diverting said biasing forces to preselected second locations of the second member.

The diverting means is in form of a lever element and so diverts the force exerted by the biasing spring or springs, that this force acts upon the reciprocable shear blade in optimum direction and at an optimum location (or locations), as considered with reference to the proper functioning of the trimmer. For example, the spring or springs may be mounted in the frame and, assuming that the trimmer is mounted so as to be inclined to the direction of force exerted by the spring, the lever element may serve to divert the force so that it acts at right angles upon the front area (i.e. the cutting-edge area) of the reciprocable blade.

In other words: the biasing force is transmitted to the blade assembly where it will be most advantageous in terms of proper functioning, which is to say as close as possible to the serrated cutting edge. A certain amount of friction between the two relatively movable blades of the assembly is, of course, unavoidable, but the invention makes it possible to assure that this friction will occur where it will do some good, namely in the area of the cutting edges which must anyhow firmly engage one another to operate properly. Conversely, where tight engagement between the blades is of no operational value, i.e. in the region of the rear edges (those spaced from cutting edges) the friction can be reduced. In consequence, the trimmer according to the invention operates more easily (requires less power to be operated). Furthermore, by eliminating the need for the biasing springs to act in direction normal to the plane of the blades the invention affords the designer and builder greater freedom in the construction of the trimmer. If desired it is also possible to use relatively weak biasing springs and to obtain sufficiently high blade-contact pressures, simply by stepping of the contact pressure through the use of appropriately dimensioned lever arms.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a fragmentary vertical section through the shear head of a dryshaver having two hair trimmers;

FIG. 2 is a fragmentary top plan view of the reciprocating shear blade of the trimmer shown at the right side of FIG. 1;

FIG. 3 is a top plan view of a deflecting lever as used in the trimmer of FIG. 1; and FIG. 4 is a section on line IV—IV of FIG. 3, but on an enlarged scale.

DESCRIPTION OF PREFERRED EMBODIMENTS

Discussing the drawing now in detail, and referring firstly to FIG. 1 thereof, it will be seen that this Figure diagrammatically illustrates a part of a dryshaver shear head which is mounted in a frame 5 and urged against a conventionally apertured shear foil 3 by a spring 2. A swing lever 4 can impart oscillatory movement to the shear head 1, in a direction normal to the plane of the drawing, as is known per se from the art.

Arranged at opposite lateral sides of the shear head 1 are two long-hair hair trimmers 6 and 7, for example one for trimming beard hair and one for trimming scalp hair. Since both trimmers are functionally identical, it will suffice to describe hereinafter only the trimmer 7 in detail.

With this in mind, it will be seen that trimmer 7 has a shear blade 8 provided with serrations and teeth 9 along one edge (the cutting edge); this blade 8 is stationarily mounted on frame 5. Located below blade 8 is a second blade 10 which again has serrations and teeth 11 along its cutting edge (compare FIG. 2). The blade 10 is in tight engagement with blade 8 and is reciprocable relative to the same.

A force diverting lever 12 according to the invention has a portion 13 which engages the blade 10 close to the teeth 11, and another portion which is provided with a bead 14 that is tiltably received in an elongated depression 15 of prismatic cross-section, which is formed in frame 5. The lever 12 can thus tilt (analogously to a balance beam) about the bead 14. Frame 5 is provided with a blind hole 17 in which a spring 16 is installed; an outer end portion of this spring 16 extends into a depression 18 which is provided on lever 12 intermediate the parts 13 and 14 of the same.

In the above-described construction the force P exerted by spring 16 tilts the lever 12 about its bead 14, so that its part 13 presses against the blade 10 near the serration 11. From a comparison with the left-side trimmer 6 it will be evident that the lever 12 so diverts the force P of spring 16 that there will be two components A and B, of which the component A is transmitted to blade 10 normal or substantially normal to the plane of blade 10.

The construction of lever 12 as a one-armed lever (i.e. seen in cross-section), provides for the particularly advantageous force distribution mentioned above. The use of the bead 14/recess 15 pivot arrangement assures that lever 12 transmits the force of spring 16 (there may of course be two or more springs, one behind the other) with minimum frictional losses and at the same time retains the lever against slippage out of its position without requiring separate means for this purpose.

As shown in FIG. 2, the blade 10 has at its edge remote from the serrations 11 a projection 20 which is raised in direction towards the blade 8 (compare FIG. 1) and which engages a corresponding projection 21 of the same. The blades 8 and 10 thus contact one another only in the area of the serrations 9 and 11 and with the projections 20 and 21; this results in still further reduction of the friction between the blades 8, 10. The same arrangement (see FIG. 1) may be provided on the trimmer 6.

In cross-sectional shape the lever 12 is a single-arm lever. Seen longitudinally, however, it is bifurcated, i.e. has two separate arms 23, 24 which are connected via a middle or bridging part 25. The head 14 is provided only on the arms 23, 24, not on the middle part 25, and the same is true of the part 13. Each arm 23, 24 has one of the recesses 18 (see also FIG. 4) in which a respective spring 16 engages. The middle part 25 is advantageously of low torque resistance, i.e. it can twist in itself so as to allow each of the arms 23, 24 to accommodate its position relative to the blade 10 independently of the respective other arm. With the lever 12 so constructed, the force with which blade 10 is pressed against blade 8 is particularly uniform over the width of the blades.

By having an individual spring 16 for each arm 23, 24 the springs may be relatively weak and therefore small, so that they can be more readily accommodated in the otherwise rather cramped environment of the shear head frame.

The use of the projection 20 provided for a stable three-point support of the blade 10, and the danger of warping of blade 10 during its honing is substantially reduced since the cutting edge is interrupted by the serrations whereas the rear edge is interrupted by the projection 20 which is the only part of it that needs to be honed. In fact, even if a slight amount of warping should occur during the honing, the contact between the blades 8 and 10 will usually still be satisfactory. The problem of warping of the stationary blade 8 during honing can be solved in a similar manner, by providing the blade 8 with the projection 21 which corresponds to and has the same purpose as the projection 20. In this case it may be advisable for aesthetic reasons, to provide a cover above the blade 8. Instead of having the projection 21 the rear edge of the stationary blade 8 (and/or the blade 10) may, however, be provided with serrations just like the cutting edge, their purpose being to reduce the danger of warping.

While the invention has been illustrated and described as embodied in a hair trimmer of a dryshaver, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hair trimmer, particularly for dryshavers, comprising a frame; a shear blade assembly, comprising a stationary first member on said frame and a second member in sliding engagement with said first member; biasing spring means between said frame and second member and exerting biasing forces in direction towards first locations of said second member; and means stationary with respect to the sliding movement of said second member and being interposed between said biasing spring means and said second member for diverting said biasing forces to preselected second locations of said second member.

2. A hair trimmer as defined in claim 1, wherein each of said members has a serrated cutting edge.

3. A hair trimmer as defined in claim 1, wherein said diverting means comprises at least one force-transmitting element having portions in engagement with said frame and with said second member, respectively.

4. A hair trimmer as defined in claim 3, wherein said force-transmitting element is a single-arm lever having one end portion in engagement with said frame and another end portion in engagement with said second member.

5. A hair trimmer as defined in claim 3, said force-transmitting element having on one portion thereof a bead, and said frame having a depression accommodating said bead so that the element can tilt on the bead.

6. A hair trimmer as defined in claim 3, said force-transmitting element being bifurcated and having two arms each provided with one portion engaging said frame and with another portion engaging said second member.

7. A hair trimmer as defined in claim 6, said biasing spring means comprising two biasing springs, each biasing spring acting upon one of said arms.

8. A hair trimmer as defined in claim 7, wherein said force-transmitting element further comprises an intermediate part connecting said arms and having low torque resistance.

9. A hair trimmer as defined in claim 1, each of said members having a serrated cutting edge and said cutting edges being in engagement with one another, each of said members also having another edge spaced from and substantially parallel to the respective cutting edge, and one of said members having at said other edge a narrow projection in sliding engagement with said other edge of the other of said members.

10. A hair trimmer as defined in claim 1, each of said members having a serrated cutting edge and said cutting edges being in engagement with one another, each of said members also having another edge spaced from and substantially parallel to the respective cutting edge, each of said members also having at said other edge a narrow projection and said projections being in sliding engagement with one another.

* * * * *